US010610059B2

(12) United States Patent
Berrigan et al.

(10) Patent No.: US 10,610,059 B2
(45) Date of Patent: Apr. 7, 2020

(54) DECONTAMINATION PROCESS

(71) Applicants: Jeffrey J Berrigan, Tooele, UT (US); Chris W Dawson, Sandy, UT (US)

(72) Inventors: Jeffrey J Berrigan, Tooele, UT (US); Chris W Dawson, Sandy, UT (US)

( * ) Notice: Subject to any disclaimer, the term of this patent is extended or adjusted under 35 U.S.C. 154(b) by 22 days.

(21) Appl. No.: 15/985,416

(22) Filed: May 21, 2018

(65) Prior Publication Data

US 2018/0333009 A1 Nov. 22, 2018

Related U.S. Application Data

(60) Provisional application No. 62/508,739, filed on May 19, 2017.

(51) Int. Cl.

| | |
|---|---|
| ***A47K 3/28*** | (2006.01) |
| ***B08B 3/02*** | (2006.01) |
| ***A62B 29/00*** | (2006.01) |
| ***B08B 1/00*** | (2006.01) |
| ***C11D 17/04*** | (2006.01) |
| *B05B 1/20* | (2006.01) |

(52) U.S. Cl.

CPC ..... *A47K 3/286* (2013.01); *A62B 29/00* (2013.01); *B08B 1/00* (2013.01); *B08B 3/024* (2013.01); *B08B 3/026* (2013.01); *C11D 17/049* (2013.01); *B05B 1/20* (2013.01); *B08B 1/006* (2013.01)

(58) Field of Classification Search

CPC ..... A47K 3/286
USPC ..... 4/602
See application file for complete search history.

(56) References Cited

U.S. PATENT DOCUMENTS

| | | | | |
|---|---|---|---|---|
| 4,890,343 | A | 1/1990 | Schlags | |
| 4,934,396 | A | 6/1990 | Vitta | |
| 5,205,306 | A * | 4/1993 | Peterson | A47K 3/287 134/104.2 |
| 5,375,275 | A | 12/1994 | Sanders | |
| 5,426,795 | A | 6/1995 | Harty | |
| 5,469,587 | A | 11/1995 | Demeny | |
| 2011/0056519 | A1 | 3/2011 | Card et al. | |

FOREIGN PATENT DOCUMENTS

| | | | |
|---|---|---|---|
| CA | 2055622 | A1 | 5/1993 |
| CN | 2265112 | | 6/2003 |
| DE | 2415906 | A1 | 10/1975 |

* cited by examiner

*Primary Examiner* — Lauren A Crane
(74) *Attorney, Agent, or Firm* — Dobbin IP Law P.C.; Geoffrey E. Dobbin

(57) ABSTRACT

A decontamination process may use significantly less water when utilizing a targeted decontamination approach. Analysis of a given decontamination situation may direct responders to set up a given Contamination Reduction Zone and follow protocols for targeted mitigation of contamination found on individual responders working the scene. By targeting and controlling the contamination, significantly fewer resources are used in response to a situation.

11 Claims, 12 Drawing Sheets

© 2016 Jeffrey J. Berrigan

© 2016 Jeffrey J. Berrigan

© 2016 Jeffrey J. Berrigan

© 2016 Jeffrey J. Berrigan

© 2016 Jeffrey J. Berrigan

© 2016 Jeffrey J. Berrigan

© 2016 Jeffrey J. Berrigan

© 2016 Jeffrey J. Berrigan

© 2016 Jeffrey J. Berrigan

DECONTAMINATION PROCESS

CROSS-REFERENCES TO RELATED APPLICATIONS

This Application claims priority, under the provisions of 35 U.S.C § 119(e)(3), as a non-provisional perfection of prior filed U.S. application No. 62/508,739, filed May 19, 2017, and incorporates the same by reference in its entirety.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to the field of individual decontamination and more particularly relates to a process by which individuals who have been in a hazardous material zone are efficiently decontaminated with less time, effort and material waste.

BACKGROUND OF THE INVENTION

Hazardous materials are a serious threat to populations and the environment. Generally, hazardous materials are categorized into three types: chemical, biological, and radiological. However, the processes utilized for the decontamination of each category are generally similar, with only slight variation. As a result, a basic decontamination process has been developed and is currently the industry standard. This industry standard uses large amounts of water to essentially wash any contaminants from an individual into a holding area. The motivation is generally fear—fear of whatever is contaminating the individual and, because of a lack of understanding of the material and its behavior, taking drastic action to remove it. The process would be akin to amputating an arm for a minor skin infection on the hand. As a result, there is tremendous waste of water in the current decontamination process, often measuring hundreds or thousands of gallons to decontaminate a few individuals in personal, laminate protective gear. This is not necessarily the wisest action in naturally arid regions or those suffering from intense drought. What is needed is a more targeted approach that involves less waste.

A process that is based on targeted application of the knowledge of how different contaminants may be contained can result in not only less water usage, on the order of 10 or fewer gallons for a number of individuals, but a higher level of competence-based reactions. The present invention represents a departure from the prior art in that the process of the present invention allows for the targeted removal and containment of various contaminants without the need for massive rinsing of water. By following the procedures outlined, all known contaminant types may be addressed competently and effectively.

SUMMARY OF THE INVENTION

In view of the foregoing disadvantages inherent in the current standard of decontamination, an improved process may provide a methodology that uses less water and provides complete protection of the individuals working an incident and the environment around them. As such, a new and improved process may comprise a targeted initial removal of contaminants followed by targeted application of decontamination fluids and a second wipe step in order to accomplish these objectives. It should be noted that by "targeted" application of decontamination fluids, what is meant is a low pressure spray application from hand held sprayers, typically under 30 psi, whereby the individuals outer protective layers are gently covered with the fluids with special attention given to obvious contaminated regions and breaks in the layers sky found at breathing apparatuses, gloves, boots, etc.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, a preferred embodiment of the decontamination method is herein described. It should be noted that the articles "a", "an", and "the", as used in this specification, include plural referents unless the content clearly dictates otherwise.

The methodology of the invention is best described by the phrase "Wipe, Spray, Wipe." Prior art systems generally used a broad scale rinsing of a contaminated individual or object to effect decontamination. This broad scale rinsing is the primary cause of the wasted water and other resources. The improved methodology utilizes targeted application of ameliorative action to eliminate contaminants from protective gear worn on an individual in an efficient manner. For most contaminants, the actions are summarized in an initial wiping of the contaminated surface; targeted application of counteracting solutions ("spray"), followed by a re-wipe of the surface, after which the personal protective equipment ("PPE") may be taken off ("doffed") and handled according to customary manners. It is to be emphasized that the methodology described herein is for the decontamination and eventual removal of an individual's PPE and is not meant to address the overall situation that requires decontamination efforts.

Figure 1:
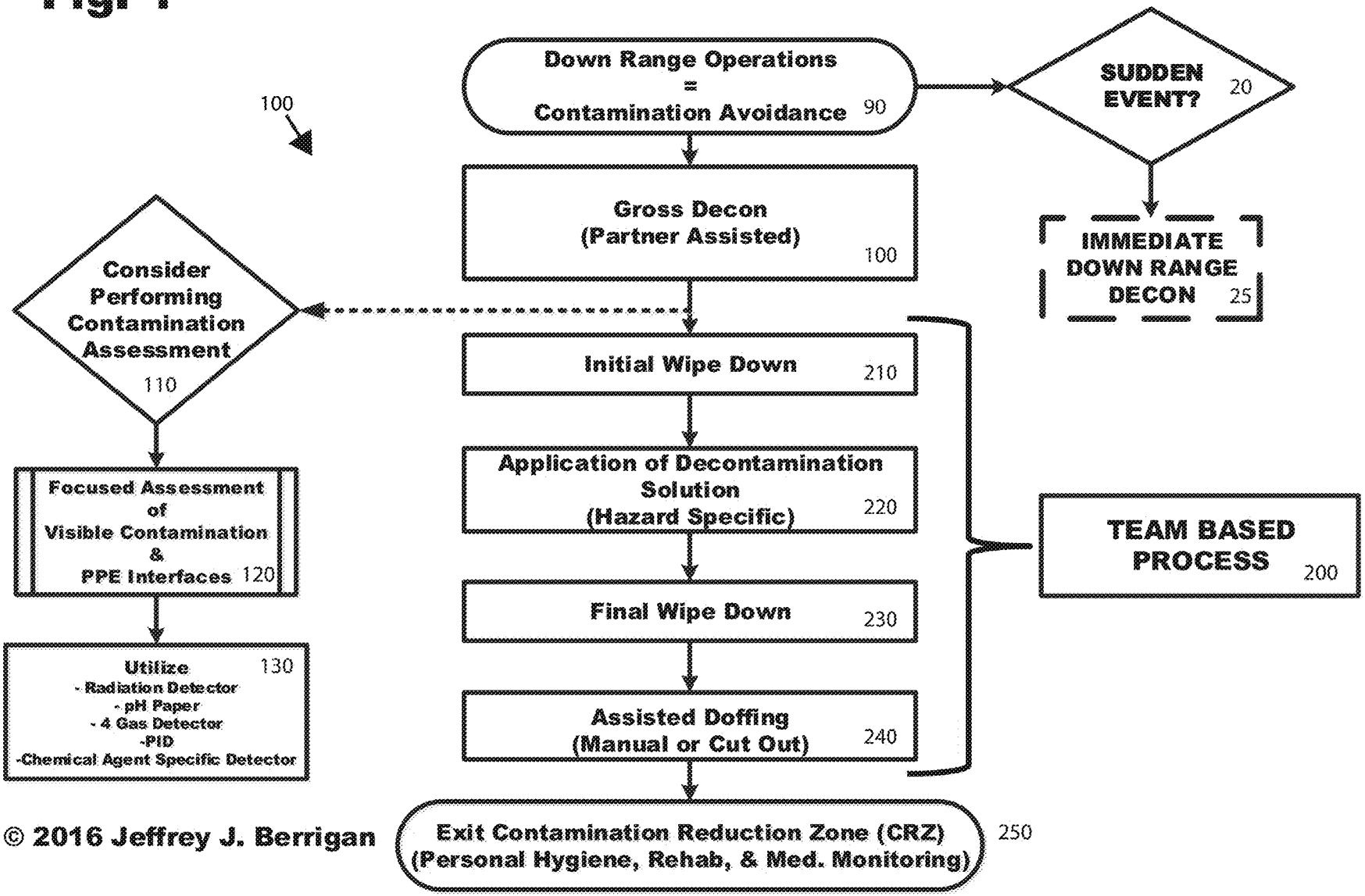
FIG. 1 is a flowchart depicting a general order model for the decontamination process.

With reference to FIG. 1, the preferred process 10 begins with a contamination event which requires downrange operations 90. In the case of sudden events 20, emergency and immediate down range decontamination must be effected 25. However, in normal situations, when an event which requires hazardous materials protocols occurs, a contamination reduction zone ("CRZ") is first established upwind from the contamination area. This CRZ is considered "warm" as opposed to the contaminated area ("hot") and the safe area ("cold"). Individuals who are working the hot zone will pass through the CRZ to become decontaminated. Many examples of CRZ setups are shown in FIGS. 9-12, and the depicted schematics are by no means exhaustive. The first step is a partner assisted "Gross Decon" which addresses large concentrations of contaminant, removes them, and keeps them in the hot zone 100. This Gross Decon is accomplished just before entering the CRZ. Once entering the CRZ, a team then assists the individual in the controlled decontamination and removal of the individual's laminate PPE and boots 200. An optional contamination assessment may be initially done before the process begins 110 and the information used to further direct the decontamination process. The contamination assessment may include a focused visual assessment of obvious contamination and PPE surfaces 120 and may involve the use of specific detection equipment, such as pH paper, radiation detectors, photo ionization detector and/or other tools 130.

Figure 2:
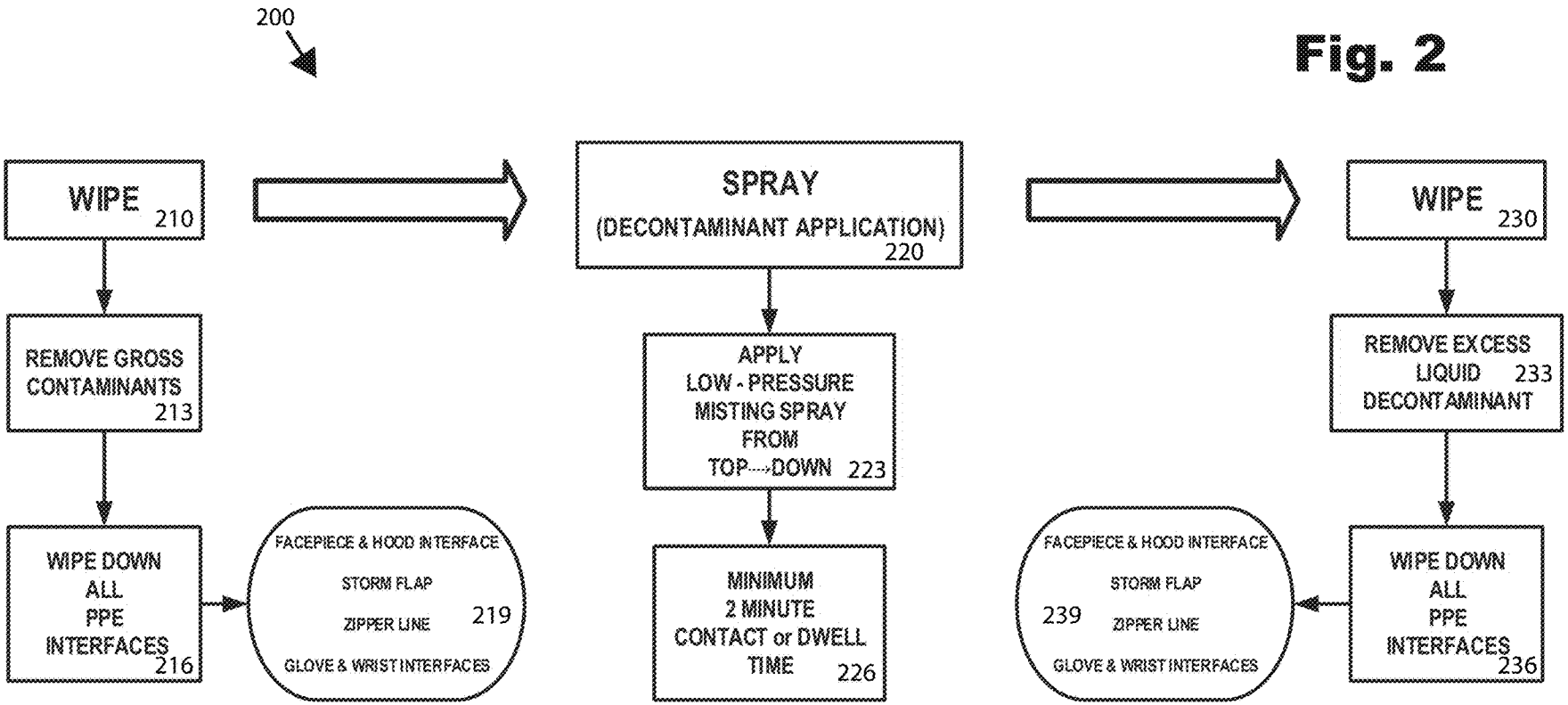
FIG. 2 is a flow chart depicting the team-based process shown in FIG.

The team-based process 200 begins when the individual enters the CRZ and the general steps are: 1. an initial wipe down of the individual 210; 2. targeted application of hazard specific decontamination solution 220; and 3. final wipe down of the individual 230. After this process, the decontamination team assists in the doffing of the individual's PPE 240 and the individual's eventual exit from the CRZ 250. FIG. 2 details the decontamination steps even further. The initial wipe 210 removes gross contaminants 213 which were missed in the initial partner assisted removal before entering the CRZ. All PPE interfaces are specifically targeted 216, including the facepiece and hood, storm flap, the zipper line and glove and wrist interfaces 219. The spray step 220 is accomplished with a low-pressure misting spray (typically less than 30 psi) of decontaminate solution from top to bottom 223 and allowing the solution to sit, wet, on the PPE for 2 minutes 226. The final wipe 230 removes the decontaminate solution from the PPE 233, again with emphasis on the PPE interfaces 236, 239.

Figure 3:
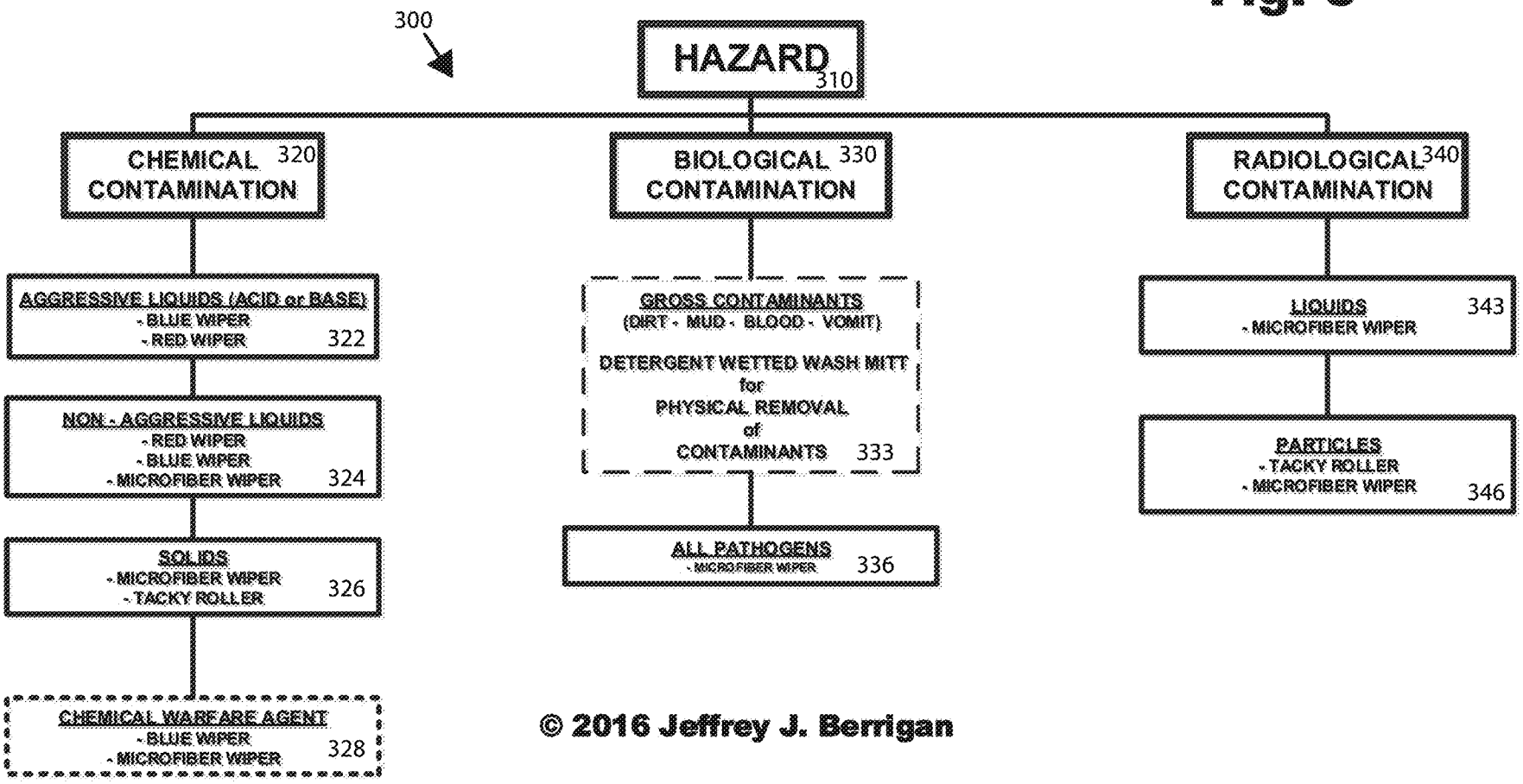
FIG. 3 is a flowchart depicting wiper selection.

Different wiping tools may be selected based on the contaminant 300. First, the hazard is identified 310. A selection guide for wipers is shown in FIG. 3. As shown, hazards may be divided into three basic types: chemical 320, biological 330, and radiological 340. All these contaminants may also be in liquid or solid form. Chemical agents 320 may be categorized as aggressive liquids 322, non-aggressive liquids 324, solids 326 or chemical warfare agents ("CWA") 328. Special consideration is used for chemical warfare agents, based on the agent. Removal may be accomplished by mundane objects, such as a tacky roller, such as is commonly used for lint, a microfiber cloth, a washing mitt, or sponge. Special wipers may be utilized, with their use dependent upon their composition. In the preferred embodiment, a polypropylene/cellulose blend wiper (often colored red) may be used for most aqueous solutions while a 100% polypropylene wiper (often colored blue) may be used for more aggressive liquids, such as acids, or liquid hydrocarbons. The actual colors of the wipers are, of course, irrelevant to the actual mechanics of the methodology but rather serve for identification purposes. Biological contaminants 330 are usually handled with a detergent wetted wash mitt 333, though microfiber wipers are preferred for specific pathogens 336. Microfiber wipers may also be used for liquid radiological contaminants 343 or particulate matter 346, though a tacky roller may also suffice for radioactive particles.

Figure 4:
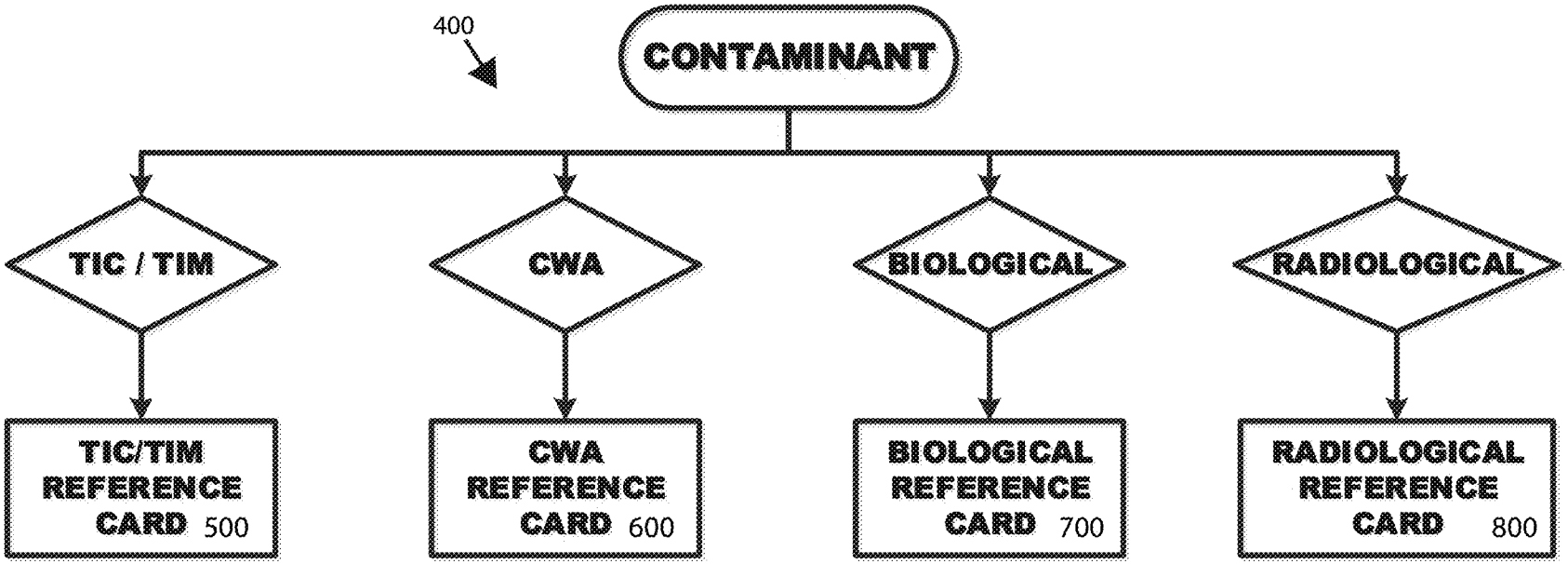
FIG. 4 is a flowchart depicting contaminant determination and strategy selection.

What should be noted is that the selection of the appropriate tool is made before the decontamination strategy is determined 400 (FIG. 4). There are four basic strategies or methodologies, one for each of four main contaminants: TIC/TIM 500, CWA 600, biological 700, and radiological 800. Once methodology is determined, appropriate setup of a CRZ is then determined and accomplished (FIGS. 9-12).

Figure 5:
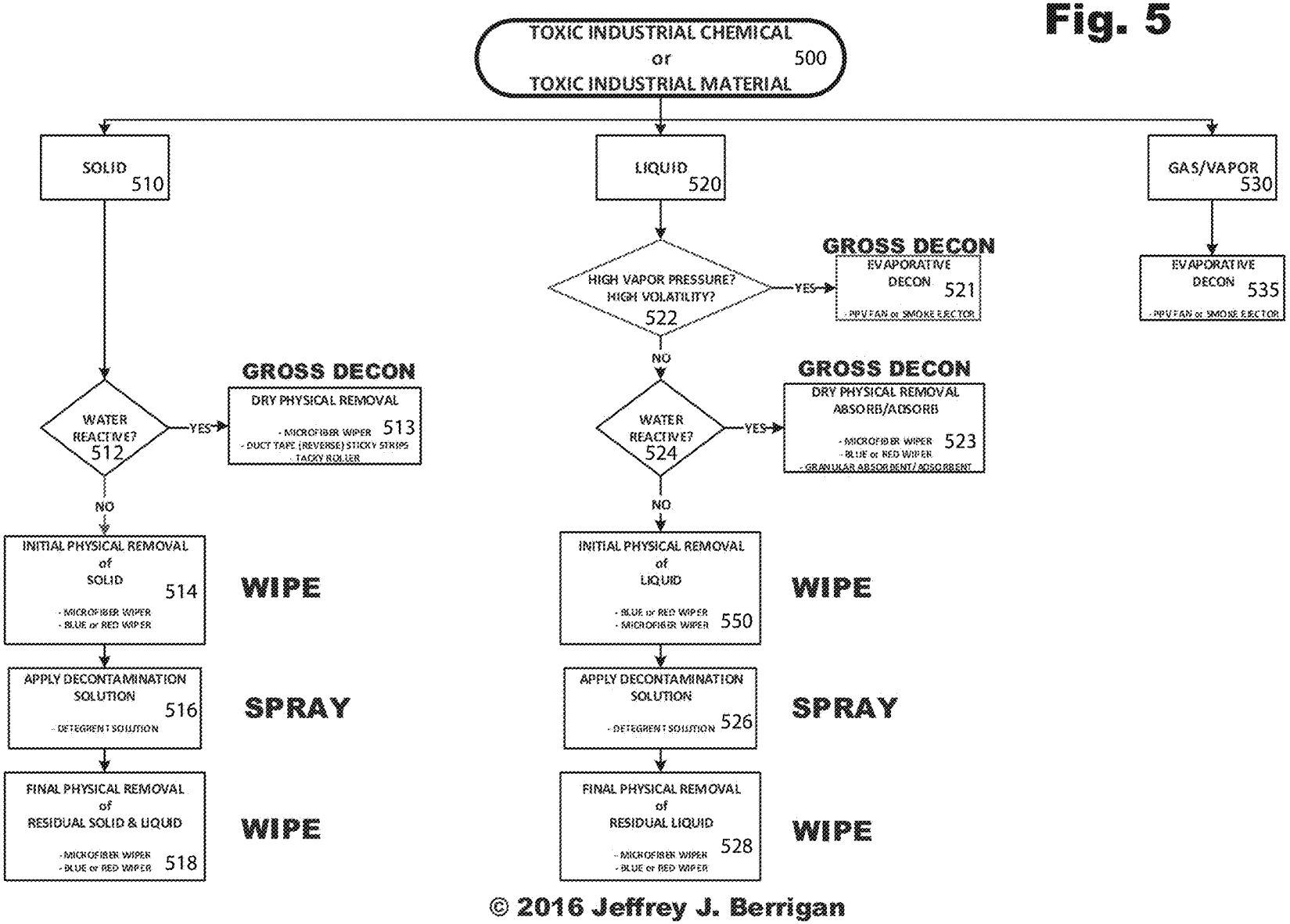
FIG. 5 is a flowchart depicting decontamination strategy for Toxic Industrial Chemicals/Materials (TIC/TIM).

Industrial waste and chemicals (TIC/TIM) are dealt with based on their physical state: solid, liquid or gas/vapor (FIG. 5). In the case of a gas or vapor 530, the contaminant is simply allowed to evaporate 535. Liquids 520 have two initial determinations. For instance, a high vapor pressure or other volatile liquid 522 would also be allowed to evaporate 521. If a liquid contaminant is known to be water reactive 542, a dry physical removal process, often requiring absorption or adsorbtion by specific compounds, is required 523. However, in all other situations, the process of "Wipe, Spray, Wipe" is followed. First an initial removal of gross contaminant is accomplished 525, followed by targeted application of decontamination solution 526, usually a detergent solution, and a final removal of the solution and any residual contaminant 528. As with liquids, solids 510 must also be identified to determine water reactivity 512, in which case dry removal 513 must be utilized, usually by a microfiber wiper, tacky roller, or even duct tape. If not water reactive, "Wipe, Spray, Wipe" is utilized 514, 516, 518, as with liquids.

Figure 6:
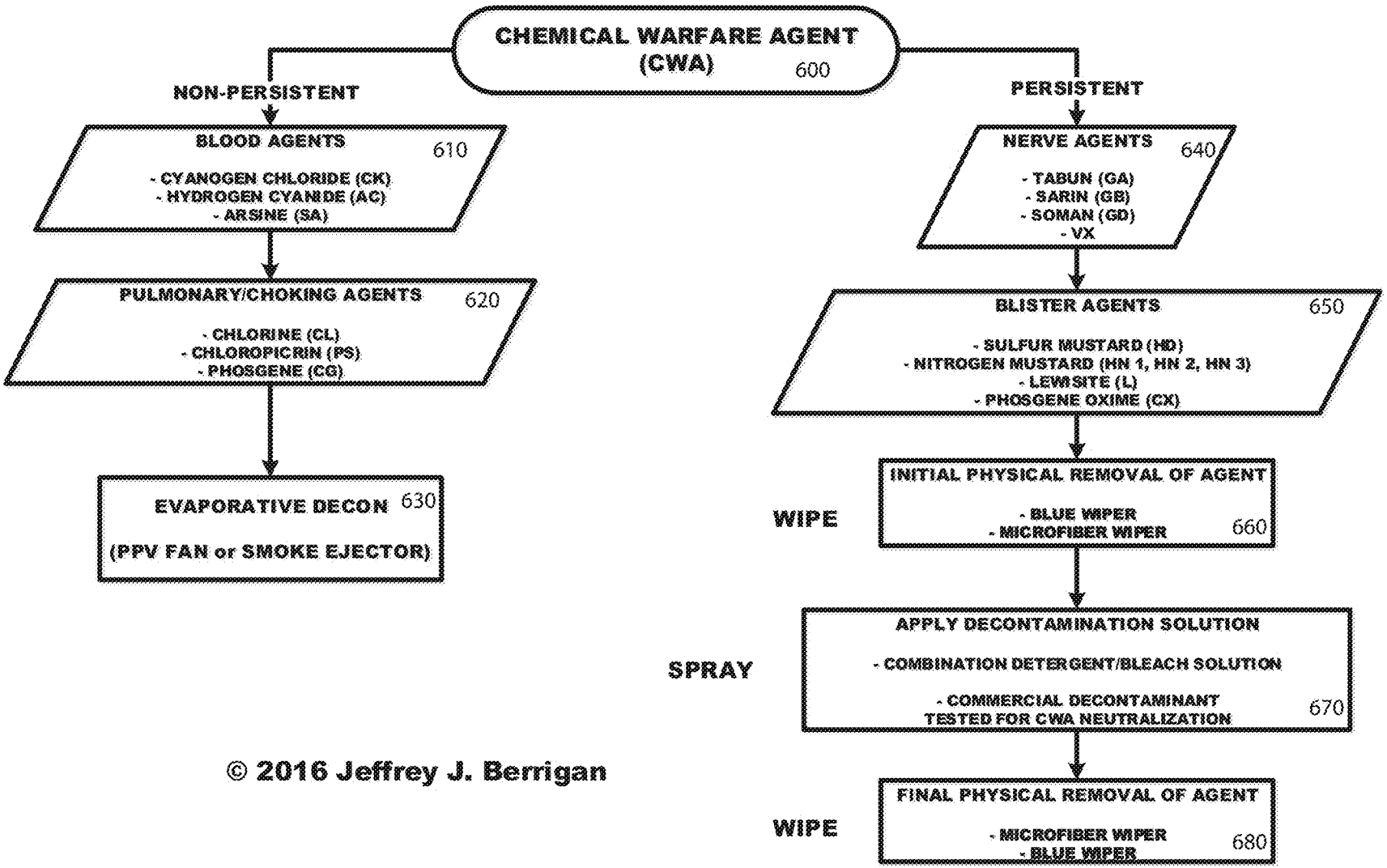
FIG. 6 is a flowchart depicting decontamination strategy for chemical warfare agents.
Figure 7:
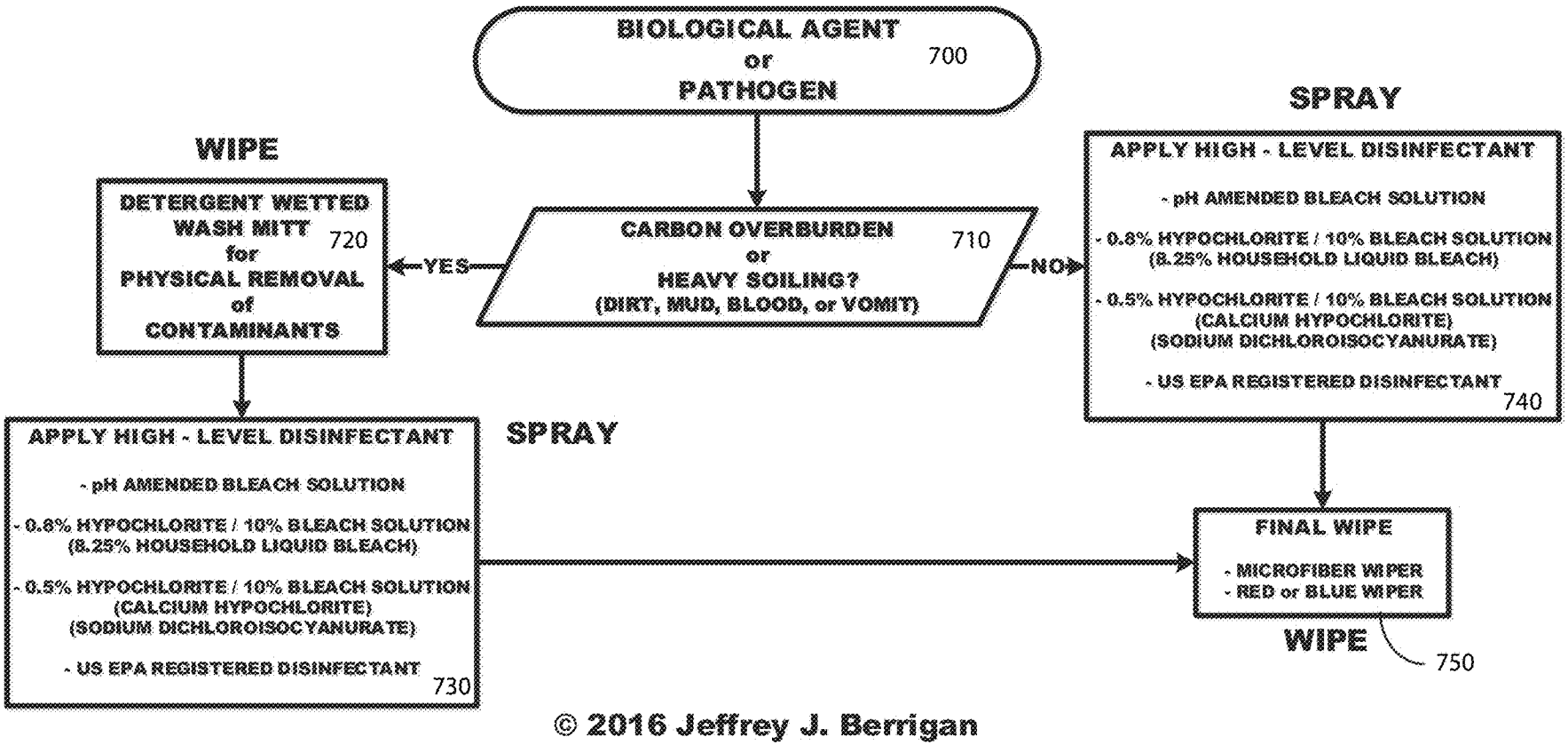
FIG. 7 is a flowchart depicting decontamination strategy for biological decontaminants.

Chemical warfare agents 600 are classified based on their persistence, or how long they tend to remain in a critical mass that could contaminate the environment. As shown in FIG. 6, non-persistent agents, which are typically but not always gasses, are allowed to dissipate from the individual.

These non-persistent agents may be blood agents 610 or pulmonary agents 620. Evaporative decontamination may be accomplished by merely waiting or may be assisted by the use of tools such as a smoke ejector or positive pressure (PPV) fan. Persistent agents are addressed by the targeted protocol. Persistent agents may include nerve agents 640 and/or blister agents 650. Initial wiping 660 should be accomplished using the 100% polypropylene wiper or microfiber 660 followed by a special decontamination spray 670. The ideal decontamination solution used should be a mixture of detergent, bleach, and water and/or specific chemical specific decontaminants. After the final wipe step 680, a test may be done to assure decontamination.

For biological agents 700, the first step is determined by the level of gross contaminant on the individual. Biological agents may be accompanied by heavy soiling or "carbon overburden" 710. For biological contaminants, a high-level disinfectant is the preferred decontamination solution. These are usually bleach, or hypochlorite, based 730, 740, though other EPA registered disinfectants may be utilized. Higher amounts of soils (mud or dirt) or other organic matter (such as blood or vomit) will deactivate such solutions quickly, simply because their presence will use up the bleach before it can fully decontaminate the individual's PPE. As such, if there is an elevated level of soiling, an initial wipe must be performed 720 with a wash mitt or similar wiper structure. If there is not, the initial wipe step may be skipped; but, the application of the solution 740 and the final wipe down must be followed 750. In this case, if the soiling is relatively inert, the initial wipe may be a wet process, such as a fine misting from a garden hose or pump sprayer.

Figure 8:
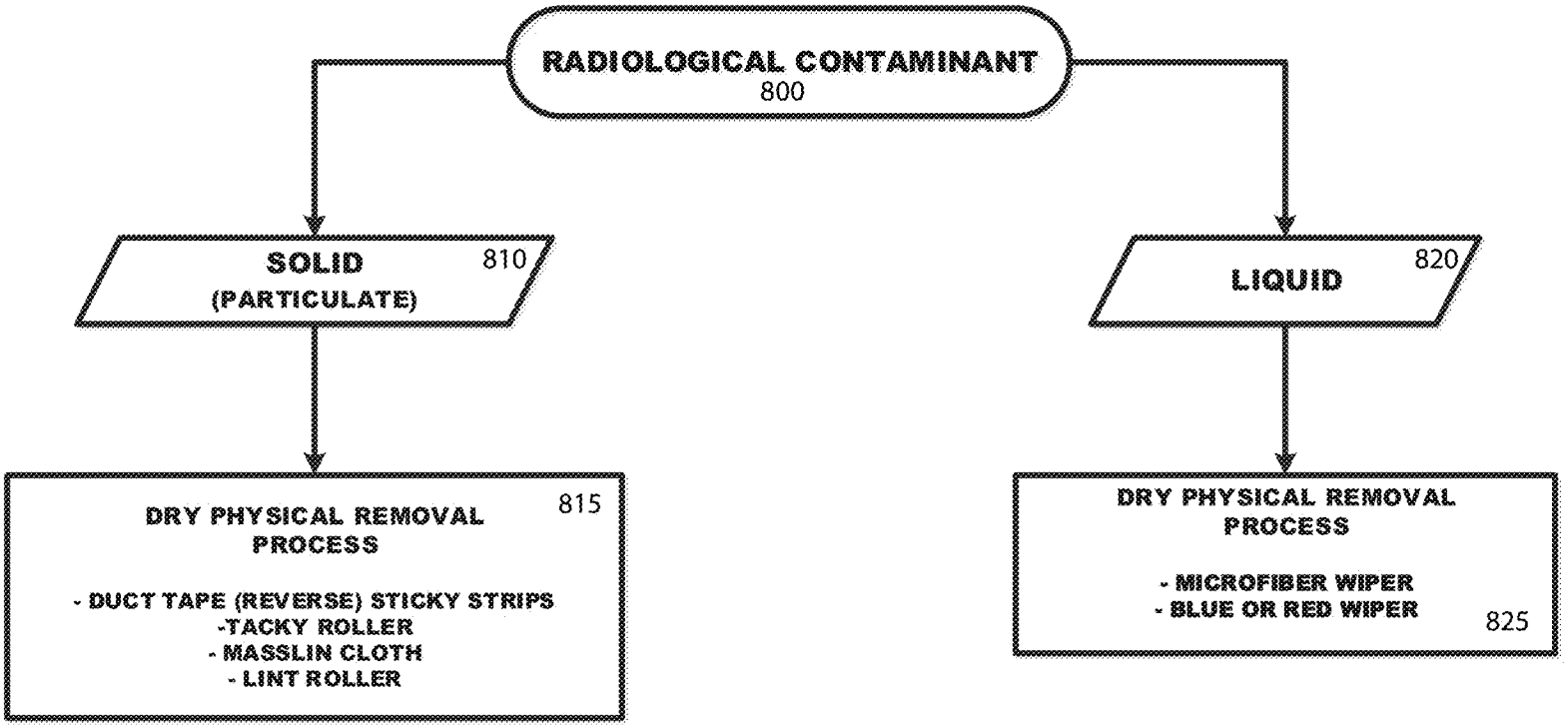
FIG. 8 is a flowchart depicting strategy for a radiological contaminant.

For radiological contaminants 800 (FIG. 8), the process is truncated to an initial dry physical removal wiping only. This is regardless of the physical state of the contaminant. If particulate 810, sticky fabrics and tapes, such as tacky and lint rollers, duct tape, sticky strips and masslin cloth, may be utilized to remove the particles 815. Liquids 820 may be removed by wiping them off with either of the main types of wipers (microfiber, polypropylene, polypropylene/cellulose) described above 825.

The decontamination solution is of paramount importance to three of the four decontamination situations described. The solutions may be detergent or bleach-based, or both. Solutions may be made in varying concentrations, with preference given to concentrations of 1-2% detergent to water (assuming a regular, off-the-shelf dish detergent is used) and, where necessary, an 0.8% hypochlorite (NaClO) solution (which is equivalent to a 10% concentration of household bleach to water). In all cases, water is first added to a chosen delivery apparatus, such as a pump or other sprayer. Then any bleach is added, followed by detergent. The solution is then mixed and used according to the method. The mixing proportions for using standard household cleaners may be found on the table below:

TABLE (US Volumes)

| Additive/ Concentration Detergent | 32 oz. | 1 gal. | 2 gal. | 3 gal. | 5 gal. |
|---|---|---|---|---|---|
| 1% concentration | .5 Tbsp. | ⅛ c. | ¼ c. | ⅜ c. | ⅝ c. |
| 2% concentration | 1 Tbsp. | ¼ c. | ½ c. | ¾ c. | ¼ c. |
| Bleach 10% (.8% NaClO) | ½ c. | 2 c. | 4 c. | 6 c. | 10 c. |

It is to be readily understood that different concentrations of detergents may be used, depending upon the effectiveness of the detergent. Also, bleaches of different concentrations may be used so long as the requisite 0.8% NaClO concentration, or an equivalent, is reached. It should also be readily understood that different decontaminants may be utilized as they are discovered and/or invented and that these ratios, concentrations, and ingredients may change, and that such changes should be considered read into this invention. For instance, appropriate use of calcium hypochlorite or sodium dichloroisocynurate may allow a reduction of the hypochlorite to a 0.5% concentration. Solutions should be changed every 2 hours for maximum efficacy, and more often in higher temperatures. Minimum contact or dwell time for these solutions should be 2 minutes, with dwell times of 5 minutes or longer possible for heavily contaminated surfaces or more stubborn, viscous, contaminates. Spray delivery is to be targeted with low pressure (under 30 psi) on the individual's PPE. This is a significant difference from the prior art which utilizes hoses, showers and other delivery devices to apply large amounts of water to an individual. A simple spray bottle or hand-pressurized sprayer are more than sufficient to accomplish the necessary fluid application.

Figure 9:
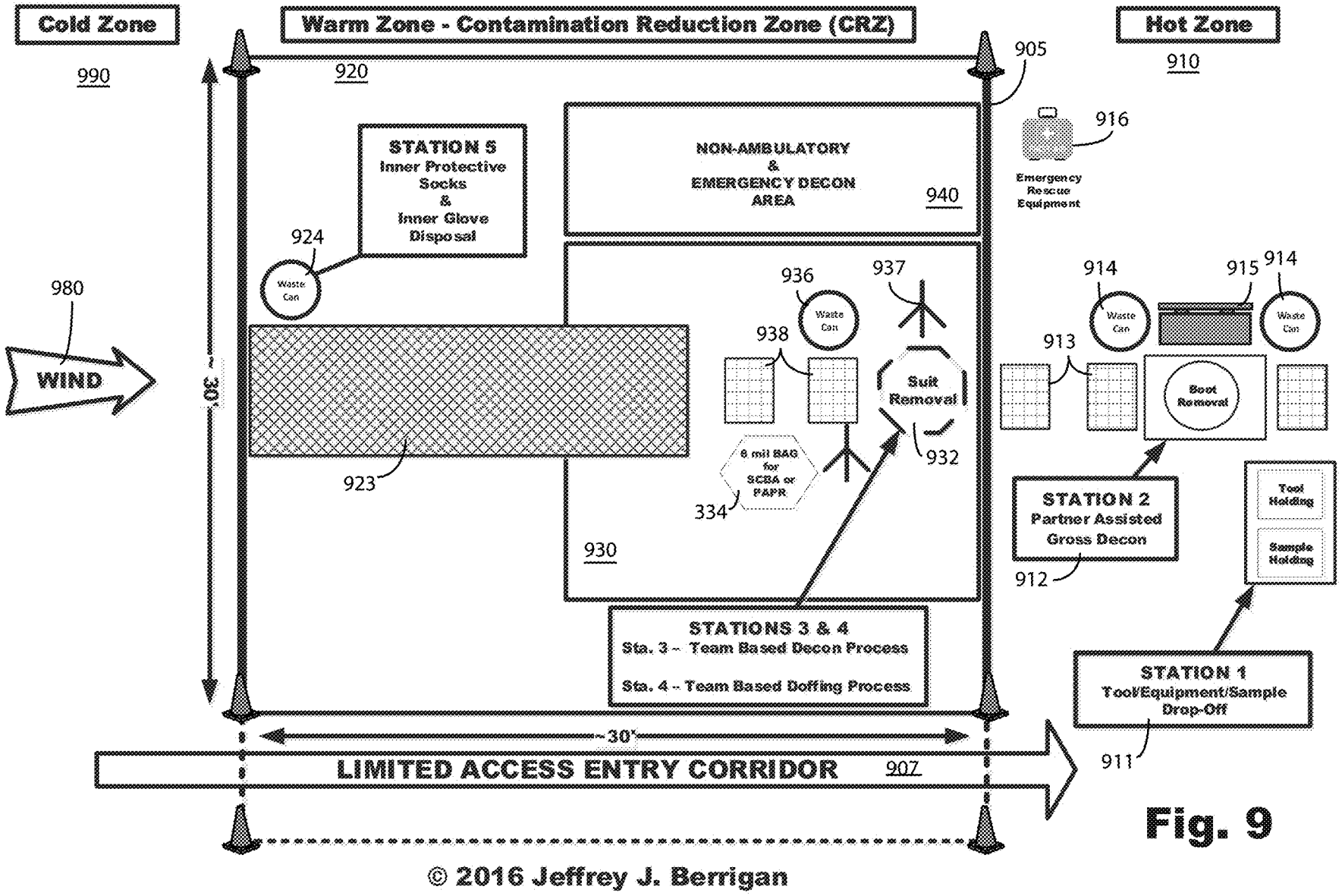
FIG. 9 is a sample decontamination placement schematic for chemical and biological contaminants.

Individual CRZ setups (FIGS. 9-12) will be dependent upon the contaminant in question, geographical and meteorological limitations, and user preference. A possible set-up is shown in FIG. 9 for either a chemical or biological situation. A limited access corridor 907 should be provided for authorized and equipped individuals to enter the hot zone 910 to address the situation. As a rule, the "hot zone" should be downwind or downstream 980 of the CRZ 920, which is demarcated by a "hot line" 905. In general, an initial pre-decontamination area may be set up in the hot zone 910 just before entry in to the CRZ 920. In this area, decontamination may be initiated by a preliminary removal of equipment, such as boots, or a general gross decontamination effort may begin. Two initial decontamination stations are present in the hot zone, one for tools and equipment 911 and the other for partner assisted gross decontamination of the individual 912. Waste cans 914 and a table 915 are provided to assist the team in initial decontamination, which may the first "wipe" of the process. Boots are intended to be removed in the second station 912, so foot pads 913 are positioned on the ground before and after the boot removal area. An emergency medical kit 916 is also provided. A decontamination team waits in the CRZ/warm zone, where the remainder of the process ("spray" and "wipe") are completed and PPE is doffed. The warm zone 920 may be further divided into an active decontamination area 930 and an emergency/non-ambulatory area 940 when a responder needs assistance. In the active area 930, an active doffing area 932 (serving as stations 3 and 4) is provided at the hot line 905. Additional waste disposal areas for breathing apparatus 934 and general waste 936 are provided. Racks 937 may be provided to help hold PPE as it is being doffed. More absorbent foot pads 938, 923 are positioned to facilitate egress towards a fifth station 924 where protective socks and inner gloves are removed and the responder may then enter the cold zone 990

Figure 10:
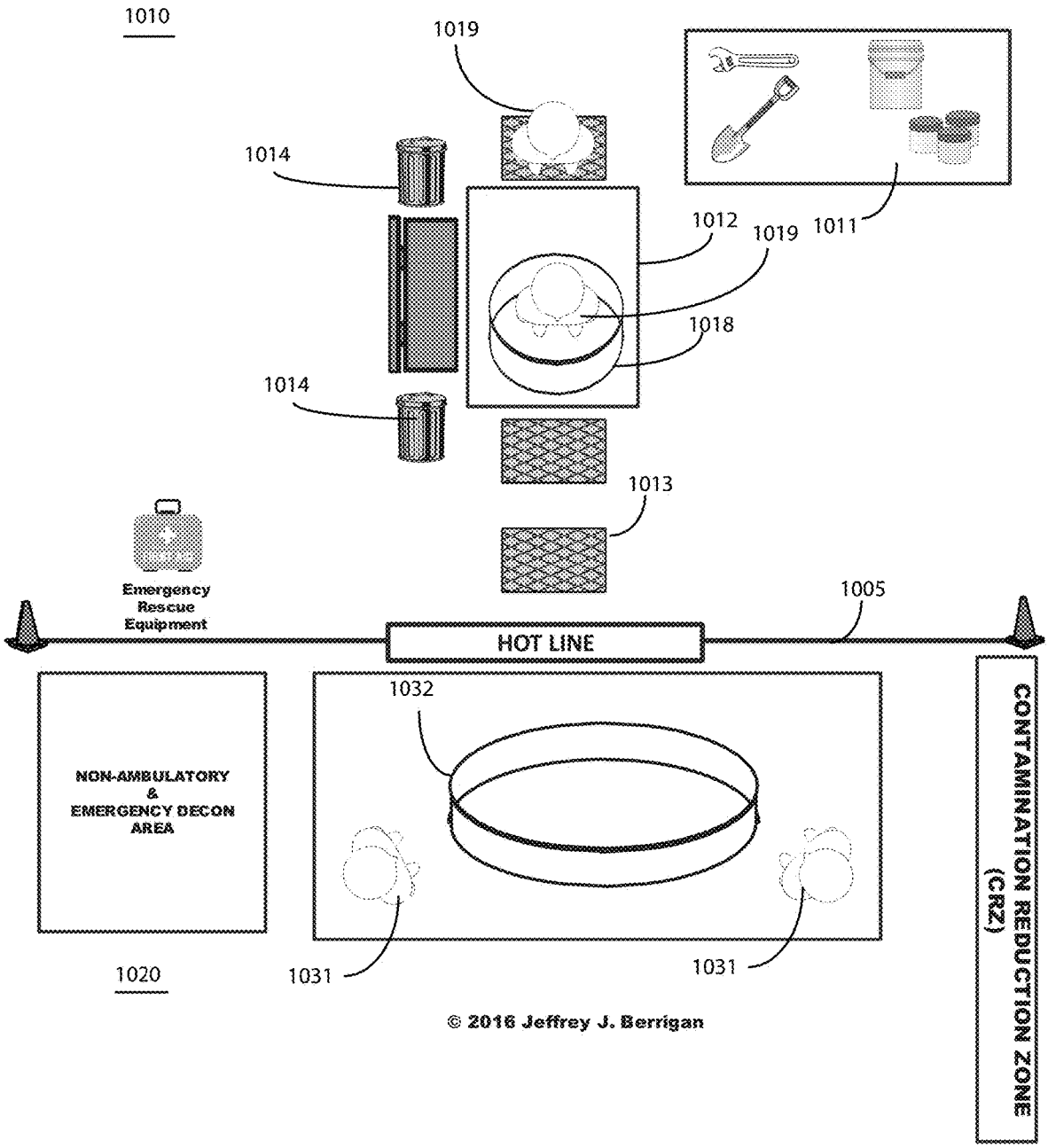
FIG. 10 is a more detailed sample placement schematic specifically for chemical hazards.

The initial decontamination process will vary slightly for a chemical hazard as opposed to a biological one. In FIG. 10, a close-up of the initial decontamination set-up of FIG. 9 is depicted, in use. Generally, a two-person team will partner in the decontamination of each other. For a chemical hazard, they will perform the following steps:

1. After placing tools and samples on the provided first decontamination station 1011, partners 1019 will inspect each other's Personal Protective Equipment, including the breathing apparatus and air supply, notifying the Team Leader of any issues;

2. Both partners 1019 will wipe feet on an absorbent pad 1013 while the first partner enters the boot ring 1018 in the second decontamination station 1012;
3. Tape is removed from the first partner's boot/overboot/suit interfaces and discarded in the boot ring waste bag (or another suitable receptacle) 1014.
4. Boots and/or overboots are removed and placed in the boot ring waste bag or other suitable receptacle;
5. Outer gloves are wiped, interface tape is removed, then outer gloves are removed and placed in the waste can 1014 or another suitable receptacle;
6. The second partner then performs a gross wipe-down of the first partner using at least one of the provided wipers;
7. The first partner exits the boot ring and wipes feet on an absorbent pad;
8. The partners switch places and the first seven steps are then repeated with the second partner in the boot ring;
9. Both partners may then approach the hot line 1005 and await the team leader's instructions, a decontamination team 1031 waits in CRZ 1020 with a doff ring 1032.

Figure 11:
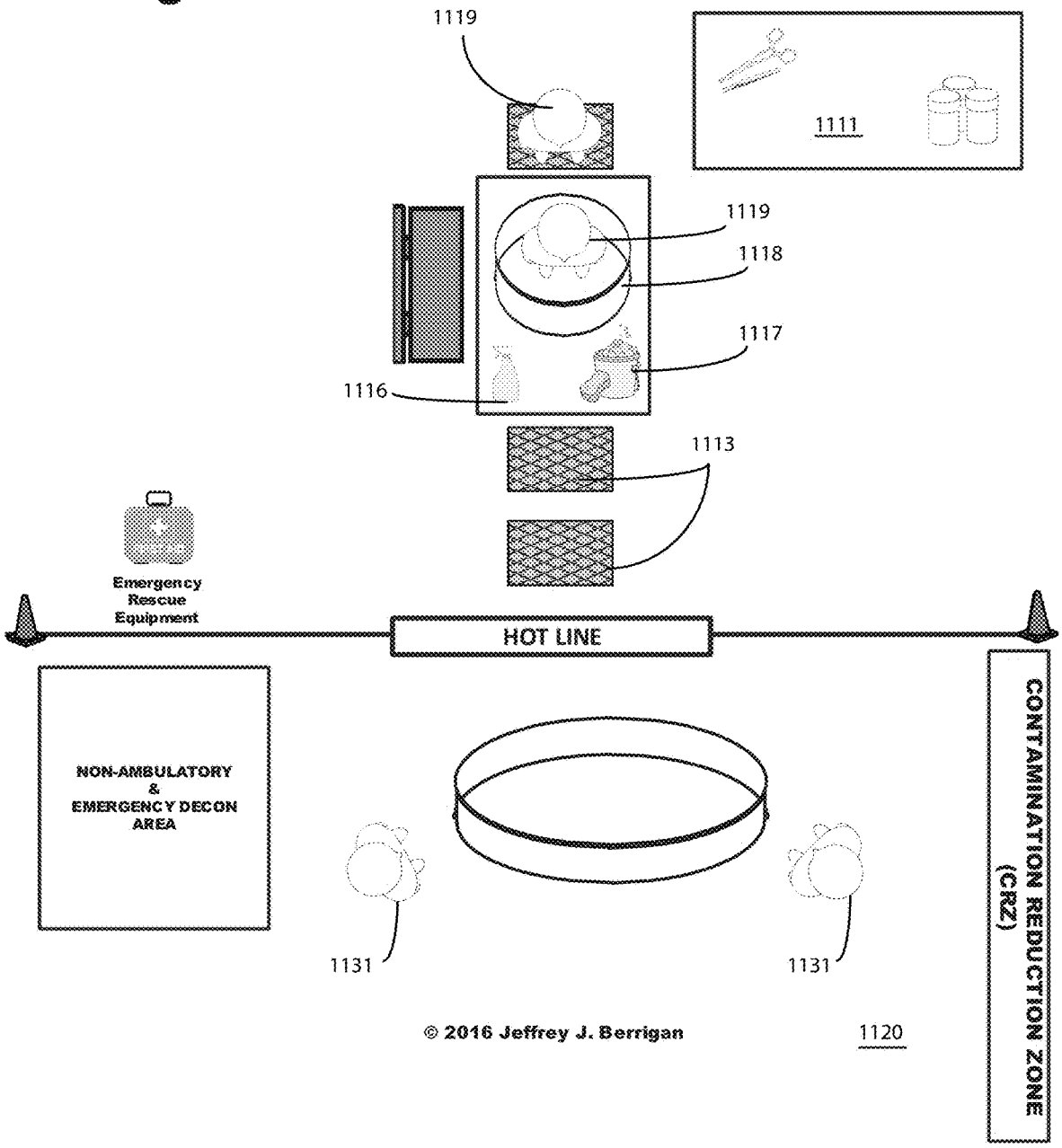
FIG. 11 is a more detailed sample placement schematic specifically for biological hazards.

For a biological hazard, as shown in FIG. 11, the set-up is similar, but utilizes a decontamination spray. The partners will follow this procedure:

1. After depositing samples and tools 1111, partners 1119 will inspect each other's Personal Protective Equipment, including the breathing apparatus and air supply, notifying the Team Leader of any issues;
2. Both partners will wipe feet on an absorbent pad 1113 while the first partner enters the boot ring 1118 in the second decontamination station 1112 where the second partner will apply a light misting spray of liquid decontaminant 1116 to the boots and gloves of the first partner;
3. The second partner then wipes down the first, head to toe, with a mitt or similar cleaning apparatus that has been lightly saturated with the decontaminant 1117.
4. Tape is removed from the first partner's boot/overboot/suit interfaces and discarded in the boot ring waste bag (or another suitable receptacle).
5. Boots and/or overboots are removed and placed in the boot ring waste bag or other suitable receptacle;
6. The first partner then dry wipes the outer gloves, removes their interface tape, then outer gloves are removed and placed in the waste can or other suitable receptacle with the tape and wipers;
7. The first partner exits the boot ring and wipes feet on an absorbent pad 1113;
8. The partners switch places and the first seven steps are then repeated with the second partner in the boot ring;
9. Both partners 1119 may then approach the CRZ 1120 where a decontamination team 1131 awaits and await the team leader's instructions.

Figure 12:
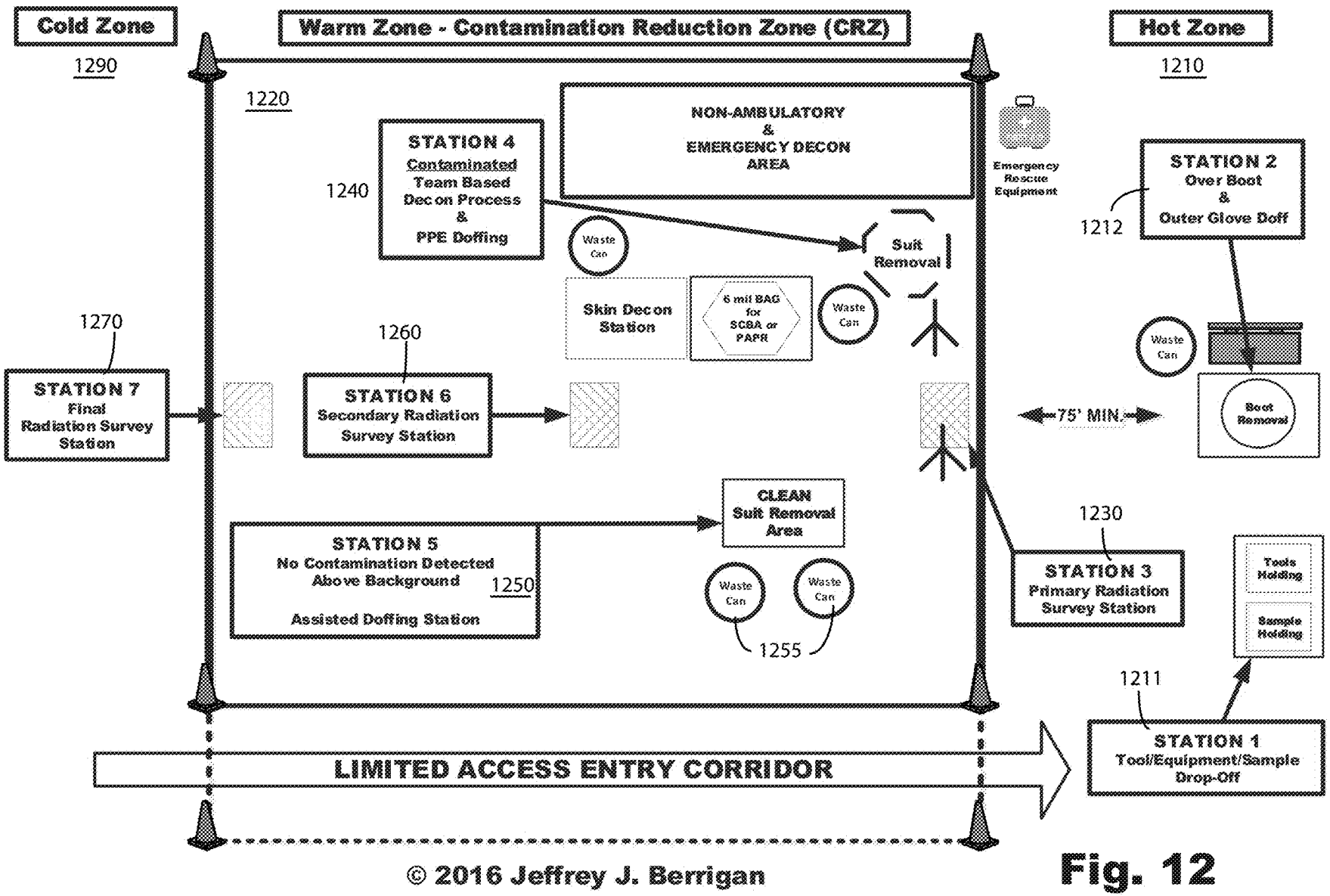
FIG. 12 is a sample decontamination placement schematic for radiological contaminants.

In FIG. 12, a setup for a radiological incident is shown, with considerably more stations, in the event radiological contamination is or is not found on the individual. As with the biological setup of FIG. 9, two initial decontamination stations 1211, 1212 are in the hot zone 1210, however entry into the CRZ prompts an initial examination for radiological contamination 1230. If there is none, the individual proceeds to doffing 1250 and removal and disposal of the PPE 1255, while detected radiological contamination leads the individual to further team-based decontamination stations 1240 before doffing. Two additional "frisking" areas 1260, 1270 are established to ensure no radiological contaminants are let into the cold zone 1290 through the CRZ 1220.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A decontamination method for an individual wearing laminate protective gear, the method comprising:

a first step whereby an initial wipe down of the laminate protective gear is accomplished;

a second step whereby a targeted application of decontamination fluids is accomplished, followed by a dwell time where the fluids are allowed to sit on the protective gear; and a third step whereby a final wipe down followed by removal of the laminate protective gear, wherein these three steps are completed in a sequential order, even if other steps intervene between them.

2. The decontamination method of claim 1, the dwell time being at least 2 minutes.

3. The decontamination method of claim 1, further comprising two initial steps of first determining an appropriate wiper based on the type of contaminant is accomplished, followed by a step where a decontamination methodology is selected.

4. The decontamination method of claim 3, the decontamination method being selected from a set of decontamination methods which target the set of contaminants consisting of: toxic industrial chemicals, toxic industrial materials, chemical warfare agents, biological contaminants, and radiological contaminants.

5. The decontamination method of claim 3, further comprising, as a third step, setting up an appropriate contamination reduction zone adjacent a hot zone based on the type of contaminant.

6. The decontamination method of claim 5, the initial wipe down step being accomplished in the hot zone and the spray and final wipe down steps being accomplished in the contamination reduction zone.

7. The decontamination method of claim 1, the decontamination fluids being a mixture of detergent, sodium hypochlorite, and water.

8. The decontamination method of claim 1, the decontamination fluids having a concentration of 0.8% sodium hypochlorite.

9. The decontamination method of claim 1, the decontamination fluid shaving a concentration of 0.5% hypochlorite.

10. The decontamination method of claim 1, the application of decontamination fluids is accomplished by utilizing a hand-held spray bottle.

11. The decontamination method of claim 1, the application of decontamination fluids is accomplished by utilizing a hand-held hand-pressurized sprayer.

* * * * *